United States Patent [19]

Fisher et al.

[11] 4,121,811

[45] Oct. 24, 1978

[54] METALLURGICAL VESSEL SUSPENSION SYSTEM

[75] Inventors: Howard M. Fisher, New Castle; Rashed N. Nagati, Mars, both of Pa.

[73] Assignee: Pennsylvania Engineering Corporation, Pittsburgh, Pa.

[21] Appl. No.: 818,557

[22] Filed: Jul. 25, 1977

[51] Int. Cl.[2] ..... C21C 5/46

[52] U.S. Cl. ..... 266/246

[58] Field of Search ..... 266/243, 244, 245, 246, 266/247

[56] References Cited

U.S. PATENT DOCUMENTS 3,756,583 9/1973 Nagati ..... 266/246

FOREIGN PATENT DOCUMENTS 2,200,849 7/1973 Fed. Rep. of Germany ..... 266/246

1,235,737 6/1971 United Kingdom ..... 266/246

*Primary Examiner*—Gerald A. Dost

*Attorney, Agent, or Firm*—Fred Wiviott

[57] ABSTRACT

A molten metal processing vessel is surrounded by a trunnion ring. A plurality of flat beam members are affixed at one end to the trunnion ring and their other ends are each apertured for pivotally engaging one of a plurality of pins extending fixedly from the vessel.

8 Claims, 2 Drawing Figures

METALLURGICAL VESSEL SUSPENSION SYSTEM

BACKGROUND OF THE INVENTION

One prior art vessel support is disclosed in U.S. Pat. No. 3,756,583 wherein a plurality of thin diaphragm members are each affixed at one end by rivets, welding or bolts to the vessel surface and their other ends are welded to the trunnion ring. While this design was a substantial improvement over prior art support apparatus, the relatively rigid connection between the diaphragms and the vessel imposed flexibility limits.

SUMMARY OF THE INVENTION

It is an object of the invention to provide a new and improved support for pneumatic metallurgical vessels.

A further object of this invention is to provide a metallurgical vessel suspension system which allows the vessel to assume a stress minimizing orientation.

Another object of this invention is to provide a suspension system which allows a relatively great distance between the vessel and its supporting ring so as to accommodate any expected dimensional changes in the vessel and to reduce the quantity of heat which is absorbed by the supporting ring due to radiation from the vessel.

Yet another object of this invention is to facilitate uniform distribution of mechanical stresses in the vessel supporting ring.

Still another object is to provide support for metallurgical vessels which does not restrict axial thermal expansion of the vessel.

How the aforementioned and other more specific objects of the invention are achieved will appear from time to time throughout the course of a detailed description of a preferred embodiment of the invention which will be set forth hereinafter.

BACKGROUND OF THE INVENTION

This invention relates to means for supporting pneumatic type metallurgical vessels for treating molten metal by the injection of air or oxygen. Typical but nonexclusive examples of such vessels are those which use lances or tuyeres for injecting gases employed in the refining process. Such vessels include refractory linings and metal shells which are subject to wide temperature variations which result in development of high and unevenly thermal stresses in the vessel and its supporting trunnion ring. For example, during a tapping operation, the area around the tap nozzle is subjected to higher temperatures than the remainder of the shell. These high and unevenly distributed thermal conditions cause the metal shell to undergo distortions which are manifested in distance changes between the shell and the structure which supports the shell within it. Such distortions must be accommodated by the members which support the shell from the ring.

The high temperature stress in the metal shell also causes creep, which means that even though the shell has been cooled, it will not return to its original shape but will be permanently deformed. As a result of this deformation and other deteriorating factors, the vessel is replaced periodically but the life of the ring may exceed that of several vessels.

DESCRIPTION OF A PREFERRED EMBODIMENT

Figure 1:
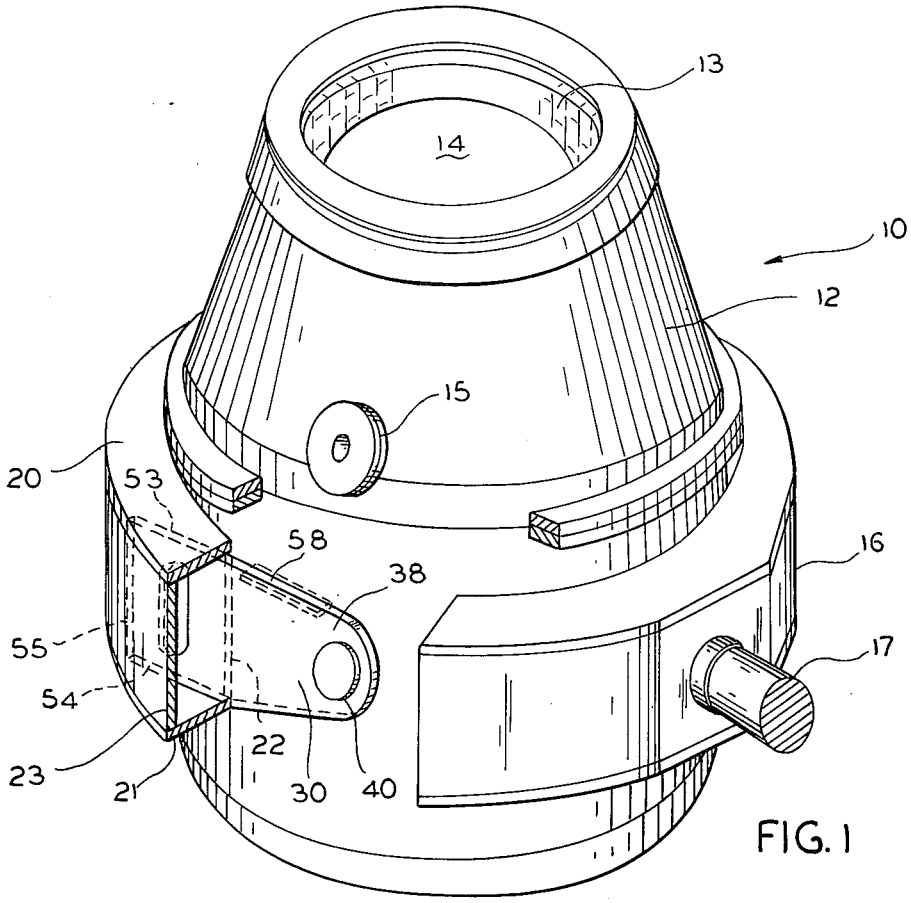
FIG. 1 is a perspective view of one type of metallurgical vessel supported in a trunnion ring, part of which is broken away to show one suspension member in accordance with the invention.

FIG. 1 shows a converter vessel 10 which is one example of a metallurgical vessel to which the new suspension system is applicable. As stated earlier, however, the suspension system is applicable to any metallurgical vessel that is supported within a so-called ring. The vessel 10 comprises a metallic shell 12 and refractory lining 13. A top opening 14 permits charging the vessel with hot metal. The vessel may have a side pouring spout 15 so that its contents may be discharged into a ladle or other suitable receptacle by tilting the vessel rather than inverting it completely.

As shown in FIG. 1, the vessel shell 10 has its longitudinal axis upright and is surrounded by a concentric trunnion ring 16. Extending from each side of the trunnion ring 16 are a pair of trunnion pins 17, only one of which can be seen in FIG. 1. These pins are usually journaled in suitable supports, not shown, and are subject to application of a torque for tilting the trunnion ring and vessel 10 which is supported on the ring. The trunnion pins 17 may be hollow so as to allow entry and exit of cooling water to the interior of the trunnion ring. In the present example, the trunnion ring interior is intended to be water-cooled but the details of accomplishing this end are omitted since they are known to those skilled in the art.

When the vessel is new and unused, there is a substantially uniform gap between shell 12 and the internal periphery of a trunnion ring 16. Although the invention is illustrated with respect to a vessel 10 and a trunnion ring 16 which appear circular in plan view, those skilled in the art will appreciate that the new vessel suspension system is applicable to ring structures which have other configurations as well. Also, the ring 16 may have a gap or be C-shaped.

Figure 2:
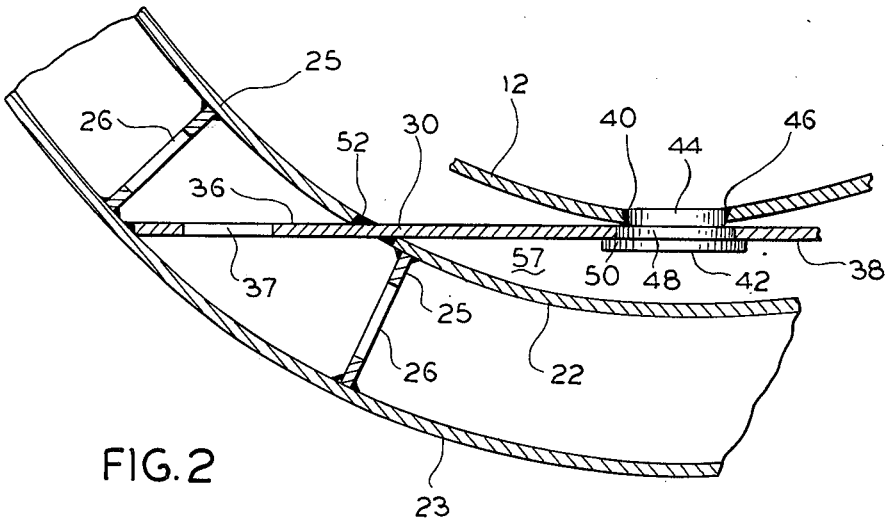
FIG. 2 is a horizontal cross section taken on a plane corresponding with 2—2 in FIG. 1.

Trunnion ring 16 comprises a top ring-like flange 20 and a similar bottom flange 21. These flanges are joined at their edges by an upstanding curved internal wrapper plate 22 and a curved external wrapper plate 23. The joints between the flanges 20 and 21 and wrapper plates 22 and 23 are welded. The trunnion ring 16 is essentially a hollow circular box girder in this example. As can be seen in FIG. 2, the trunnion ring 16 may be reinforced internally by a series of circumferentially spaced radially disposed plates 25 each of which has a hole 26 to permit circulation of cooling water, if desired, internally of trunnion ring 16. It will appear that the new means for suspending a vessel in a ring is applicable whether the ring is a hollow box girder or is in another form such as an I-beam or a channel or various other cross-sectional shapes.

In this example, vessel 10 is supported from trunnion ring 16 by a plurality of beams or diaphragms 30, only one of which is shown. Beam 30, which is shown in FIGS. 1 and 2, typifies all of the beams, and will be described in detail. Beam 30 is a long flat steel member which has one end 36 extending into the interior of trunnion ring 16. The one end 36 could extend in between the flanges of an I-beam or channel, for example, or merely abut against a suitable member if a ring other than a box type were used. This end 36 is provided with an aperture 37 so that the flow of cooling water interiorly of the trunnion ring will not be interrupted. The other beam 30 extends at an angle, other than a right angle, relative to a radius of trunnion ring 16 and is disposed generally tangentially relative to the shell 12. The other end 38 of beam 30 is apertured at 40 for receiving a shear pin 42 affixed to shell 12. More specifically, pin 42 has a reduced diameter portion 44 that is received within and is welded to a suitable aperture formed in shell 12. The body 48 of pin 42 has a larger diameter and is received within aperture 40 while a larger diameter head 50 bears against the outer surface of beam 30. Aperture 40 is preferably slightly larger than body 48 so that beam 30 may rotate relative to its associated pin 42.

Internal wrapper plate 22 may be made in segments or may be slotted to permit beam 30 to emerge from the interior of the trunnion ring. The joints between internal wrapper plate 22 and beam 30 may be welded as designated with the numeral 52. The top edges 53 and the bottom edge 54 of the planar beams are respectively welded to the bottoms and tops of flange rings 20 and 21 of the trunnion ring assembly. The end 55 of the beam is also welded to the internal surface of the external wrapper plate 23. Thus, it will be seen that forces developed by the weight of the vessel and its charge, which may be 1,000 tons or more, will be transmitted through beam 30 and variously distributed to the flanges 20 and 21 and the wrapper plates 22 and 23 of trunnion ring 16. Because the end portions 36 of the beam 30 is welded on four sides where said portions are at an incline to a vertical radial plane through the trunnion ring, the stresses are distributed relatively evenly to the trunnion ring rather than being concentrated in one small region.

Note that the beam 30 stands edgewise in respect to the axis of vessel 10 and ring 16 and that the long edges 52 and 54 of end portion 36 are spaced apart by a distance or height which is equal to the axial distance between the lower surface of top ring flange 20 and the upper surface of lower ring flange 21. In other words, the axial dimension or height of the beam 30 is less than the axial dimension or height of the trunnion ring 16 and the beams are entirely within the axial limits of the ring 16. As stated earlier, this construction results in the beam stresses being distributed to all of the components of the trunnion ring 16, that is, to the top and bottom flanges 20 and 21 and to inside wrapper plate 22 and outside wrapper plate 23 and the construction also results in avoiding having the beams bearing solely on or being supported solely from the top and bottom members or flanges 20 and 21 of the trunnion ring.

It will be appreciated that there are a plurality of beams 30 distributed about the vessel 10 and located in accordance with the requirements of the system. For example, six such beams distributed equidistantly around the vessel periphery should provide adequate support. All of the beams in this example extend at substantially the same angle and in the same direction generally circumferentially of the space within ring 16 and its internal perimeter. It will be appreciated that the central region of beams 30 bridges the gap 57 between wrapper plate 22 and vessel shell 10. Each of the beams 30 supports the vessel in the double cantilever mode and each accepts part of the load when the vessel is upright or tilted.

It should be apparent that if top and bottom flanges 20 and 21 were actually similarly positioned flanges of an I-beam or channel, assuming that the ring was formed of such structural member, the ends 36 of the beam could be extended into the space between the flanges as with a box girder trunnion ring and welded to the flanges and the web of the structural member. The advantages of having the beam loads on the flanges would still apply.

From the foregoing comments it will be obvious to those skilled in the art that the ends of beams 30 which are connected to the trunnion ring 16 are effectively cooled so as to maintain the strength which the beam metal has at lower temperatures. This permits use of less metal in the diaphragms or beams than would otherwise be required. It also permits having a larger gap 19 between vessel 10 and trunnion ring 16 so as to reduce heat transfer to the trunnion ring and to avoid contact and accompanying stresses that might result from vessel 10 becoming unduly distorted after prolonged use. Because a portion of each beam is covered by the trunnion ring flanges and because of the smooth plane surfaces on the exposed parts of the beams 30, there is less opportunity for contaminants to collect on the beams and cleaning costs are reduced, although a slag deflector 58 may be provided.

A further advantage of the invention is that exposed portions 38 of the beam 30 can bend or flex radially to accommodate localized or general distortion of vessel 10 without the danger of excessive internal stresses being developed in metal shell 10. All of the beams can yield inwardly toward the center of the vessel or outwardly toward the trunnion ring and yet the central axis of the vessel will remain in substantial coincidence with the axis of the trunnion ring. The pivotal connection between the vessel and the end of the beam 30 provided by pin 42 permits a change in the angle of incidence therebetween to minimize stresses due to creep. Also, in prior art systems where the ends of the beams were riveted or bolted, the rivets or bolts might not be uniformly stressed in the event of a force tending to pivot or rotate the beam. This might result in sequential failure of such bolts or rivets. The pin 42 provides a larger diameter, single member so as to minimize the tendency for such failure.

While only a single embodiment of the invention has been illustrated and described, it is not intended to be limited thereby but only by the scope of the appended claims.

I claim:

1. The combination comprising:

a metallurgical vessel, tiltable support means encompassing at least a portion of the vessel and being spaced therefrom to define a gap therebetween, a plurality of beam means each of which extend into said gap at substantially the same angle and each of which are attached at one end to said support means, each of said beam means having a corresponding portion extending toward said vessel in a common direction, and a plurality of pins affixed to said vessel and extending generally radially therefrom, an aperture formed in the other end portion of each said beam, one of said pins extending through each aperture whereby said vessel is supported on said support means, each said beam means being pivotable about its respective pin, said pins supporting said vessel on said beam means which provide the sole support for said vessel.

2. The combination set forth in claim 1 wherein said beams means comprise relatively flat elongate members disposed generally tangent to the surface of said vessel and said pins extending generally normal to said beam means.

3. The combination set forth in claim 2 wherein said pins each have a cylindrical surface and each said aperture is circular and larger in diameter than its associated pin, each pin being the sole coupling between its associated beam means and said vessel.

4. The combination set forth in claim 3 wherein each pin has a head formed thereon and on the side of its associated beam remote from said vessel, each said head being larger in cross-sectional area than its associated aperture and acting to retain said beam on said pin.

5. The combination set forth in claim 4 wherein said support means including first and second interconnected, spaced apart support portions surrounding said vessel and each lying substantially within a plane intersecting the axis of said vessel, said first and second support portions defining the margins of a beam receiving space therebetween presented to said vessel, said plurality of beam means being disposed in spaced apart relation between said support portions and said vessel, each of said beam means having one end extending into the beam receiving space formed by said support portions and having edge portions secured to each of said support portions.

6. The combination set forth in claim 11 wherein said first and second support portions comprise spaced apart members surrounding said vessel and each of which lie in spaced apart planes substantially perpendicular to the axis of said vessel, said beam means each extending into the space between said members and having edge portions thereof affixed to said members, and a third support means interconnecting said first and second support portions.

7. The combination set forth in claim 6 wherein said support portions comprise spaced apart flange means and inner and outer wrapper plate means coupled to said flange means to define a hollow structure, said beam means extending from between said spaced apart flange means in a common direction into said space, the edges of said one portion of said beam means being welded respectively to both flange means, to the external wrapper means and to the internal wrapper means where the beam means extends from the latter, said beam means having at least one water circulation hole therethrough.

8. The combination set forth in claim 7 wherein:

the edges of the said one end portion which is fixed to the support means are welded to said flange means and said wrapper plate means.

* * * * *